United States Patent [19]

Kowalski

[11] Patent Number: 4,660,883

[45] Date of Patent: Apr. 28, 1987

[54] SAFETY PLATFORM ARRANGEMENT FOR RECLINER

[75] Inventor: Jerome R. Kowalski, Hickory, N.C.

[73] Assignee: Hickory Springs Manufacturing Company, Inc., Hickory, N.C.

[21] Appl. No.: 787,659

[22] Filed: Oct. 16, 1985

[51] Int. Cl.[4] ..... A47C 1/02

[52] U.S. Cl. ..... 297/85; 297/68; 297/463

[58] Field of Search ..... 297/68, 85, 463, 75

[56] References Cited

U.S. PATENT DOCUMENTS

| | | | |
|---|---|---|---|
| 3,083,996 | 4/1963 | Caldemeyer et al. | 297/75 |
| 3,096,118 | 7/1963 | Dubeck | 297/75 |
| 3,429,612 | 2/1969 | Cobb | 297/75 |
| 3,494,660 | 2/1970 | Caldemeyer et al. | 297/68 |
| 3,781,060 | 12/1973 | Pentlien | 297/85 |
| 4,190,282 | 2/1980 | Crawford | 297/68 |
| 4,570,996 | 2/1986 | Rogers, Jr. | 297/85 |

*Primary Examiner*—James T. McCall

*Attorney, Agent, or Firm*—Shefte, Pinckney & Sawyer

[57] ABSTRACT

A safety platform arrangement for use in virtually any footrest or recliner type chair provides a safety platform pivotably attached to the footrest and supported horizontally by a transverse support rod mounted to the linkage mechanism of the chair or directly to the seat thereof to close the space which otherwise would exist between the footrest and the seat in any footrest or reclining positions of the chair. The platform prevents persons or objects from becoming entrapped and damaged or injured upon accidental or unintended closing movement of the footrest.

20 Claims, 9 Drawing Figures

SAFETY PLATFORM ARRANGEMENT FOR RECLINER

BACKGROUND OF THE INVENTION

The present invention relates generally to chairs having extendable and retractable footrests and, more particularly, to reclining chairs of the type having a linkage arrangement interconnecting a seat structure and footrest for coordinated movement between reclining and non-reclining positions.

Reclining chairs, or as more commonly referred to in the art simply as "recliners," have been well known for many years and have become one of the most popular and common items of residential furniture. As a result, considerable activity has been devoted over the years to the design and production of various modifications and improvements in recliners, resulting in a considerable diversity in the particular structures and manners of operation thereof. For instance, the simplest and perhaps most common recliner construction provides a stationary chair frame, a seat structure having a seat member and seat back rigidly connected with one another, a footrest, and a relatively simple lazy tong type linkage mechanism mounted on the chair frame and supporting the seat structure and footrest for coordinated movement thereof between a non-reclining position with the seat structure generally upright and the footrest retracted and a reclining position with the seat structure rearwardly tilted to some degree and the footrest extended forwardly at a spacing therefrom. In more advanced forms of recliner linkages, the seat member and seat back are movable with respect to one another and provide several different possible chair positions. Some recliner constructions further provide the capability for rocking motion, as well as reclining, of the seat structure.

Despite the great diversity of conventional recliner structures, substantially all recliners have in common the provision of a footrest movable as aforementioned from a retracted position adjacent or within the chair frame and an extended position spaced forwardly from the seat structure. The reclining motion of many of the simpler forms of recliner linkages is actuated merely by occupant-exerted force rearwardly against the seat back of the seat structure to cause the footrest to be thrust forwardly and the seat structure to recline rearwardly and, in reverse, by the opposite occupant-exerted force on the seat structure and/or downwardly against the footrest. Some of the more advanced forms of recliner linkages provide an occupant-operated handle as part of the linkage arrangement to require handle movement to move the recliner into its reclining position as well as to return it to its non-reclining position.

In recent years, the design of the aforementioned relatively simple forms of recliner linkages have come under attack by various consumer groups as a result of a number of accidental injuries, as well as a few deaths, to young children each of whom were accidentally entrapped by the footrest of a recliner of this sort when the footrest in its extended position unexpectedly closed under the child's weight while playing unsupervised on the recliner. While recliners of the more advanced type having handle-operated reclining linkages do not suffer the same problem in that the simple exertion of force on the footrest when in its extended position is not alone sufficient to actuate closing movement of the footrest, such recliners nevertheless pose potential hazards to children as well as adults due to the open space created between the seat structure and the footrest of such recliners when in a reclining position.

In response to this apparently growing problem, the American Furniture Manufacturers Association and the Consumer Product Safety Commission recently issued a joint warning to owners of recliners concerning the potential safety hazard to young children playing on reclining chairs. Of course, warnings in themselves will not prevent further accidents and therefore a substantial need exists in the furniture industry for a satisfactory improvement in the construction of recliners to alleviate this potential danger. To explore this possibility, the AFMA has established a special committee to attempt to define an industry safety standard for recliner manufacturers.

It is accordingly a principal object of the present invention to provide an improved safety mechanism for incorporation in conventional recliner structures to prevent accidental entrapment of persons or objects in the normal spacing existing between a recliner footrest and seat structure in its reclining position.

SUMMARY OF THE INVENTION

Most basically, the present invention is adapted for incorporation in any chair of the general type having a seat structure, a footrest, and some arrangement for selectively moving the footrest between a retracted position adjacent the seat structure and an extended position at an outward spacing from the seat structure. Briefly described, the present improvement provides a safety platform arrangement for movement between an inoperative position withdrawn within the seat structure when the footrest is in its retracted position and an operative position spanning and substantially closing the spacing between the seat structure and the footrest when the footrest is in its extended position. In this manner, the safety platform arrangement prevents objects from extending through such spacing which would otherwise ordinarily exist in chairs of this type and thereby prevents accidental entrapment of objects in the spacing during movement of the footrest from its extended position to its retracted position.

Preferably, the safety platform arrangement is incorporated in a reclining-type chair having a chair frame and a linkage mechanism mounted thereon for supporting the seat structure and the footrest for movement relative to the chair frame between a non-reclining position wherein the seat structure is generally upright relative to the chair frame and the footrest is in its retracted position and a reclining position wherein the seat structure is reclined relative to the chair frame and the footrest is in its extended position. Basically, the safety platform arrangement in this preferred embodiment includes a platform member attached to the footrest for movement therewith and a support member for constraining the platform member to move with the footrest between the aforesaid inoperative and operative positions of the platform member. In many conventional reclining chairs, the footrest when retracted assumes a generally upright disposition adjacent the chair frame with one side of the footrest facing upwardly adjacent the seat structure, the footrest when extended assuming a generally horizontal disposition with the one side thereof facing rearwardly toward the seat structure. In such embodiments, the safety platform is pivotably affixed at the one side of the footrest, the support member being adapted to constrain the platform member to move with the footrest in a generally horizontal path in close proximity to the seat structure with the platform member being angularly related with the footrest when retracted and being generally aligned with the footrest when extended.

In conventional recliners of the type utilizing a lazy tong footrest linkage mechanism including a pair of lazy tong assemblies connected in spaced relation to one another for unitary extending and retracting movement, the support member may be a cross member affixed to and extending transversely between the lazy tong assemblies. Alternatively, the support member may include a bracket, e.g. a U-shaped bracket, affixed to the underside of the seat member of the seat structure to receive and guide the platform member in movement between its inoperative and operative positions. dr

DESCRIPTION OF THE PREFERRED EMBODIMENT

Figure 1:
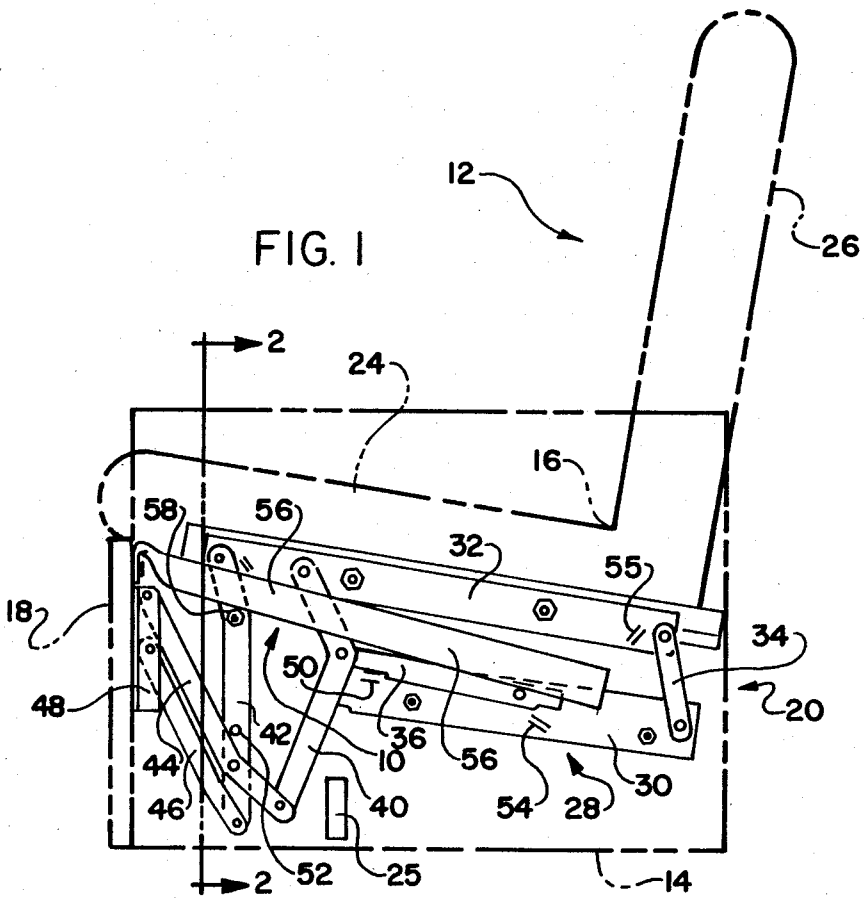
FIG. 1 is a side elevation of the safety platform arrangement of the present invention as preferably embodied in a conventional prior art reclining chair incorporating a simple so-called "two-way" recliner linkage mechanism, showing the linkage mechanism and the chair structure in their non-reclining position and the safety platform arrangement in its inoperative position, with the chair structure per se being shown in broken lines for clarity of illustration and understanding.
Figure 2:
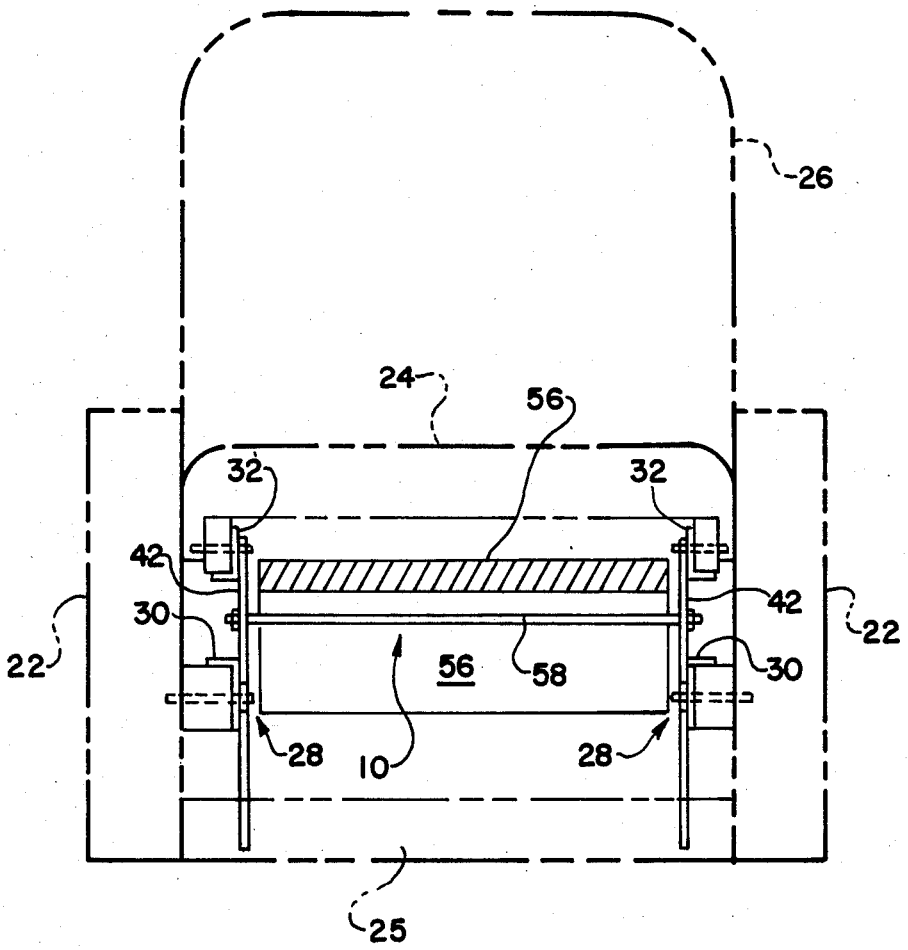
FIG. 2 is a vertical cross-section of the recliner of FIG. 1 taken along line 2—2 thereof.

Referring now to the accompanying drawings and initially to FIGS. 1 and 2, the safety platform arrangement of the present invention is indicated generally at 10 as preferably embodied in an otherwise conventional upholstered reclining chair indicated at 12.

Basically, the chair 12 includes a base frame structure 14, a seat and back rest unit 16, a footrest 18, and a linkage mechanism 20 mounted on the base frame structure 14 and supporting the seat and back rest unit 16 and the footrest 18 for movement relative to the base frame structure 14 between the non-reclining position of FIG. 1, the footrest position of FIG. 3, and the reclining position of FIG. 6, as more fully explained hereinafter. The base frame structure 14 includes a pair of upholstered side frame armrest members 22 arranged in upright spaced parallel relation to one another and joined by appropriate cross frame members 25. (See FIG. 2). The seat and back rest unit 16 includes a seat portion 24 and a back rest portion 26 rigidly joined together in angular relation to form the unit 16 as an integral body-supporting structure which is upholstered as a unit. The footrest 18 is a substantially planer rectangular member upholstered similarly to the side frame armrest members 22 and the seat and back rest unit 16. The seat and back rest unit 16 and the footrest 20 are mounted by the linkage mechanism 20 transversely between the side frame armrest members 22.

The linkage mechanism 20 basically includes a pair of linkage assemblies 28 formed as identical mirror-images of one another and mounted respectively to the inwardly-facing surfaces of the two side frame armrest members 22. As illustrated in FIGS. 1, 3 and 6 on the drawings, only the one linkage assembly 28 at the opposite side of the recliner 12 is illustrated for purposes of clarity, it being understood that the near side of the recliner 12 includes an identical mirror-image linkage assembly 28 as indicated in FIG. 2. Each linkage assembly 28 includes an armrest mounting plate 30 affixed in substantially horizontal relation to the respective side frame armrest members 22 and a seat mounting plate 32 extending generally coextensively above the armrest mounting plate 30 and similarly affixed in generally horizontal relation to the seat member 24 along its adjacent laterally facing side. In each linkage assembly 28, a rear support link 34 extends between and is pivoted respectively to each of the rearwardmost ends of the armrest and seat mounting plates 30, 32. A recline stop link 36 is pivoted at one end thereof to a central area of the armrest mounting plate 30 and a sequence link 38 (FIG. 6) is similarly pivoted at one end thereof to the forwardmost end of the armrest mounting plate 30. The respective other ends of the recline stop link 36 and the sequence link 38 are pivoted, respectively, to spaced intermediate locations on a rear footrest drive link 40 one end of which is pivoted to the seat mounting plate 32 at a slight rearward spacing from its forwardmost end. A front footrest drive link 42 is pivoted at one end thereof to the forwardmost end of the seat mounting plate 32. A top footrest support link 44 is pivoted at one end thereof to the other end of the rear footrest drive link 40 and the top footrest support link 44 is additionally pivoted at an intermediate location thereon to an intermediate location on the front footrest drive link 42. A bottom footrest support link 46 is pivoted at one end thereof to the other end of the front footrest drive link 42. The respective other ends of the top and bottom footrest support links 44, 46 are pivoted, respectively, to spaced locations on a footrest mounting bracket 48 which is affixed to the adjacent end of the footrest 18.

As illustrated in FIG. 1, the linkage assemblies 28 enable the linkage mechanism 20 to assume a folded condition correspondingly to position the seat and back rest unit 16 and the footrest 18 in a retracted non-reclining position as illustrated. In such folded condition of the linkage assemblies 28, the forward end of the recline stop link 36 rests on a stop member 50 formed on the forward end of the armrest mounting plate 30, with each of the front and rear footrest drive links 42, 40, the top and bottom footrest support links 44, 46, and the rear support link 34 oriented respectively in generally vertical dispositions, the folding movement of the top footrest support link 44 relative to the front footrest drive link 42 being restricted by a stop member 52 on the front footrest drive link 42. The seat mounting plate 32 thus assumes a substantially horizontal disposition generally parallel to the armrest mounting plate 30 to position the seat member 24 in a correspondingly horizontal disposition and the back member 26 in an essentially vertical disposition, while the footrest mounting bracket 48 assumes an essentially vertical disposition to orient the footrest 18 vertically adjacent the forward vertical surfaces of the side frame armrest members 22 immediately adjacently below the forward side of the seat member 24.

With the recline stop link 36 resting on the stop member 50, the extent of the rear footrest drive link 42 between the recline stop link 36 and the seat mounting plate 32 forms a nearly parallelogram-like linkage in conjunction with the armrest and seat mounting plates, 30, 32 and the rear support link 34 to facilitate generally linear forward-rearward movement of the seat and back rest unit 16 by the relative pivotal movement of these components of the linkage assemblies 28. At the same time, the front and rear footrest drive links 42, 40 and the top and bottom footrest support links 44, 46 provide essentially a lazy tong type linkage in conjunction with the seat mounting plate 32 and the footrest mounting bracket 48, for relative retracting movements of these components upon respective forward and rearward movements of the seat mounting plate 32. In this manner, the linkage assemblies 28 may assume an intermediate unfolded condition as shown in FIG. 3 to orient the seat and back unit 16 and the footrest 18 in a so-called footrest position with the seat and back unit 16 translated rearwardly but still oriented substantially upright and the footrest 18 extended forwardly into a generally horizontal disposition at a spacing S from the seat member 24. A stop member 55 is positioned in each seat mounting plate 32 to abut the rear support link 34 in the footrest position to limit such movement of the linkage assemblies 28.

As will be understood, in the initial folded condition of the linkage assemblies 28 of FIG. 1, the recline stop link 36 is incapable of pivoting with respect to the armrest mounting plate 30 under the constraint of the sequence link 38. However, in the intermediate partially unfolded condition of the linkage assemblies 28 shown in FIG. 3, the sequence link 38 has moved with the rear footrest drive link 40 into general alignment with the recline stop link 36. Accordingly, from the partially unfolded condition of the linkage assemblies 28 in FIG. 3, the recline stop link 36 is capable of upward pivoting movement relative to the armrest mounting plate 30 to move the seat mounting plate 32 into a rearwardly inclined disposition relative to the armrest mounting plate 30. The upward pivoting movement of the recline stop link 36 is restricted by a stop member 54 positioned on the armrest mounting plate 30 to abut the rearwardly projecting portion of the recline stop link 36 when it is oriented at a preselected acute angle with respect to the armrest mounting plate 30. In this manner the linkage assemblies 28 may be moved into a fully unfolded condition shown in FIG. 6 wherein the seat and back rest unit 16 is reclined to orient the seat member 24 at an acute angle with respect to horizontal and the back rest member 26 at a similarly acute angle with respect to vertical with the footrest 18 at a slightly higher elevation than in the footrest position of FIG. 3 but otherwise remaining extended at essentially the same forward spacing S from the seat member 24.

Figure 3:
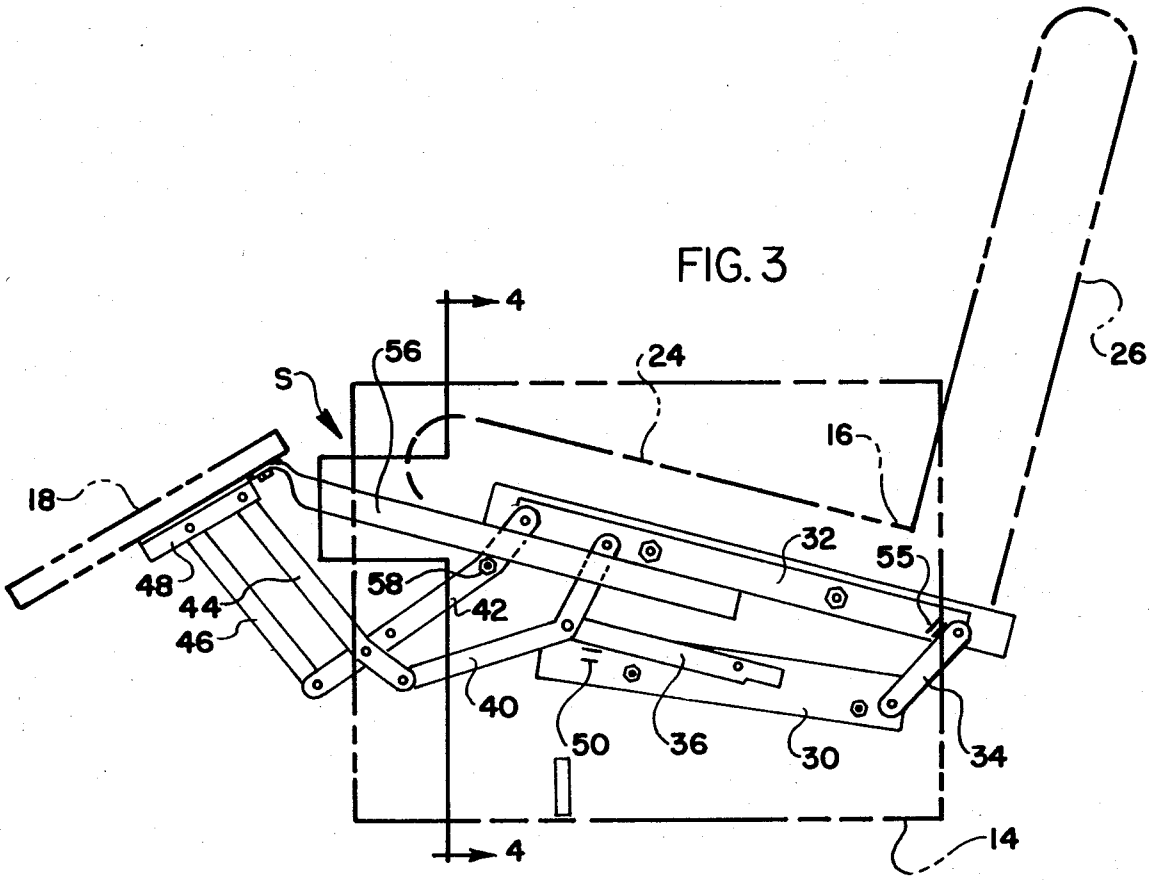
FIG. 3 is another side elevation of the recliner of FIG. 1 showing the chair structure and linkage mechanism in their intermediate footrest position and the safety platform arrangement in a first operative position thereof.
Figure 6:
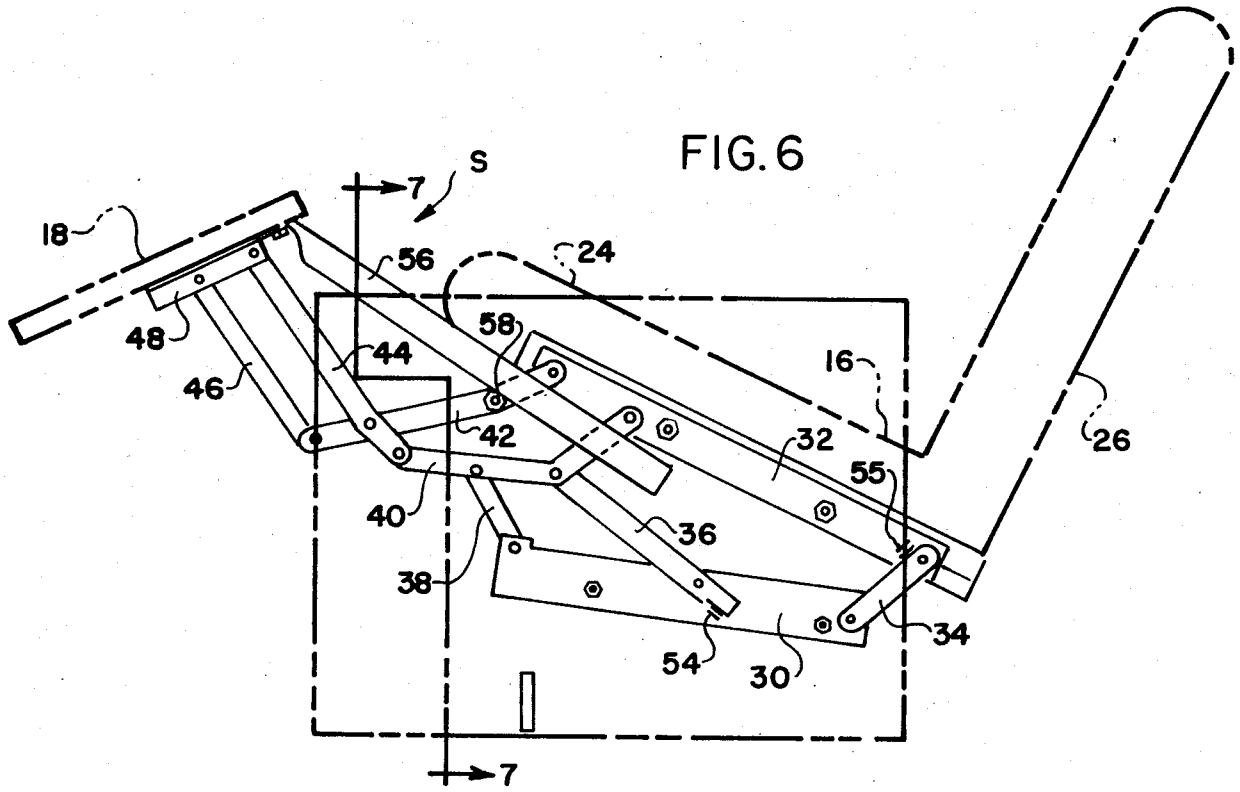
FIG. 6 is another side elevation of the recliner of FIG. 1 showing the chair structure and linkage mechanism in their fully reclined position and the safety platform arrangement in a second operative position thereof.

As will be understood, the sequence link 38 essentially functions to constrain the linkage assemblies 28 to always move sequentially through the intermediate partially folded condition of FIG. 3 in all folding and unfolding movements of the linkage mechanism 20 between the folded condition of FIG. 1 and the fully unfolded condition of FIG. 6. However, in the fully unfolded condition of the linkage assemblies 28 shown in FIG. 6, only a relatively small amount of downward force on the seat member 24 is required to move the linkage assemblies 28 into the intermediate partially folded condition of FIG. 3. Similarly, in the intermediate position of FIG. 3, only a relatively small amount of downward force on the footrest 18 is required to fully close the linkage assemblies 28 to the folded condition of FIG. 1. Accordingly, the linkage mechanism 20 is a prime example of the type of conventional linkage mechanism which is subject to the danger and risk of accidentally entrapping a person or other object in the space S existing between the extended footrest 18 and the seat member 24 in either the footrest position of the chair 12 occurring when the linkage mechanism 20 is in its intermediate partially unfolded condition or the reclining position of the chair 12 occurring when the linkage mechanism 20 is in its fully unfolded condition.

Figure 4:
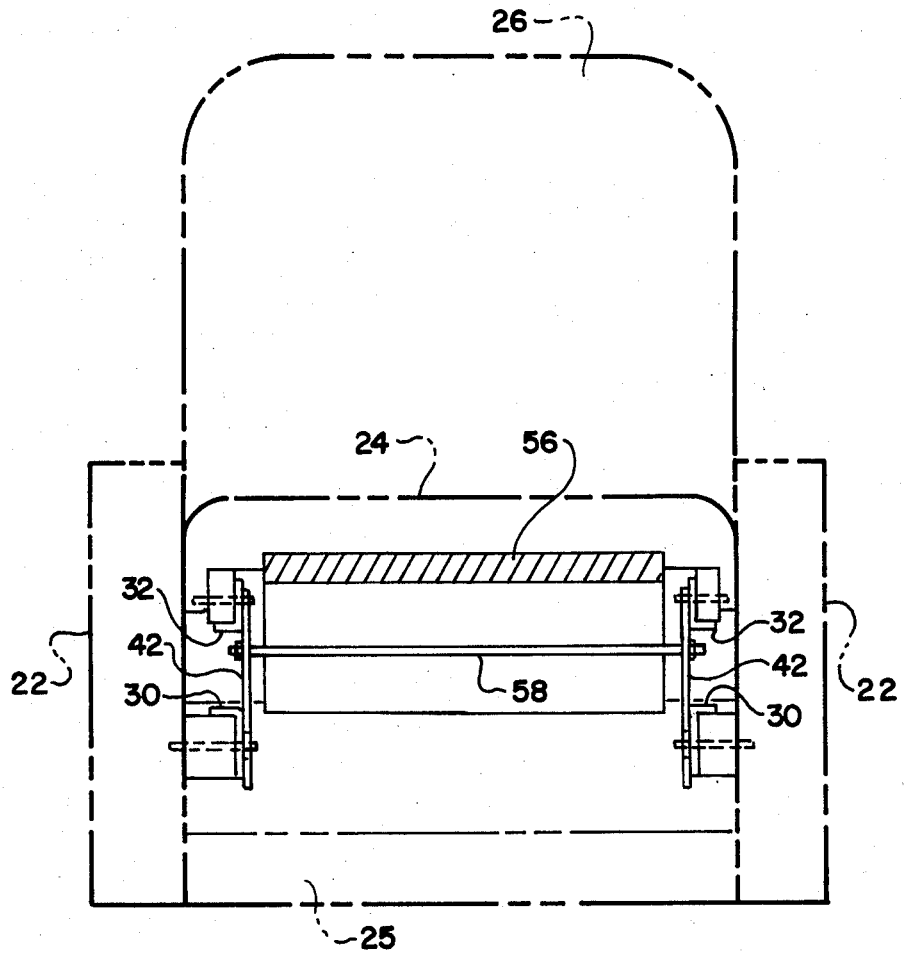
FIG. 4 is a vertical cross-section of the recliner of FIG. 3 taken along line 4—4 thereof.
Figure 5:
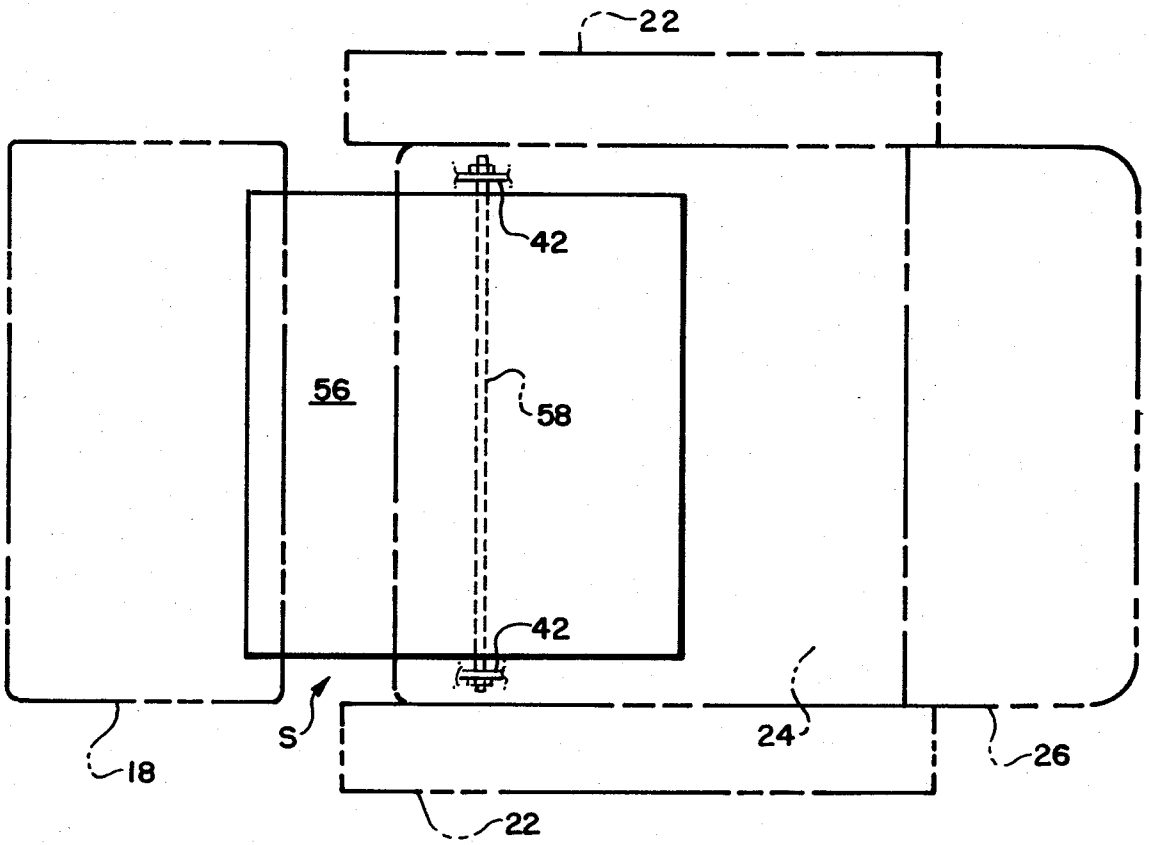
FIG. 5 is a top plan of the recliner of FIG. 3.
Figure 7:
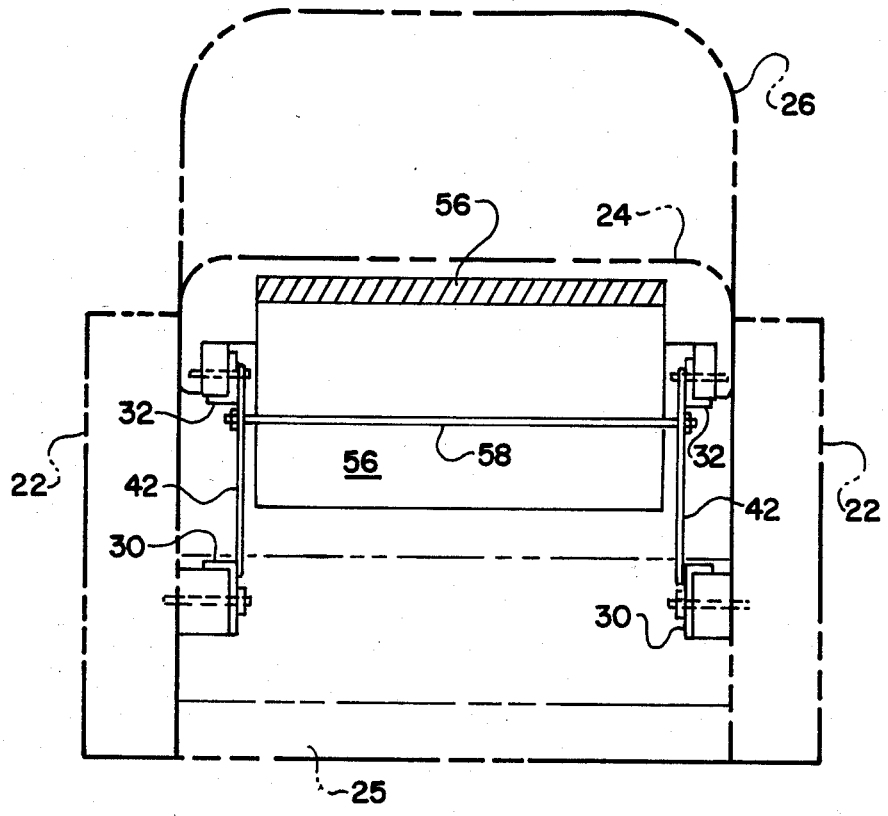
FIG. 7 is a vertical cross-section of the recliner of FIG. 6 taken along line 7—7 thereof.
Figure 8:
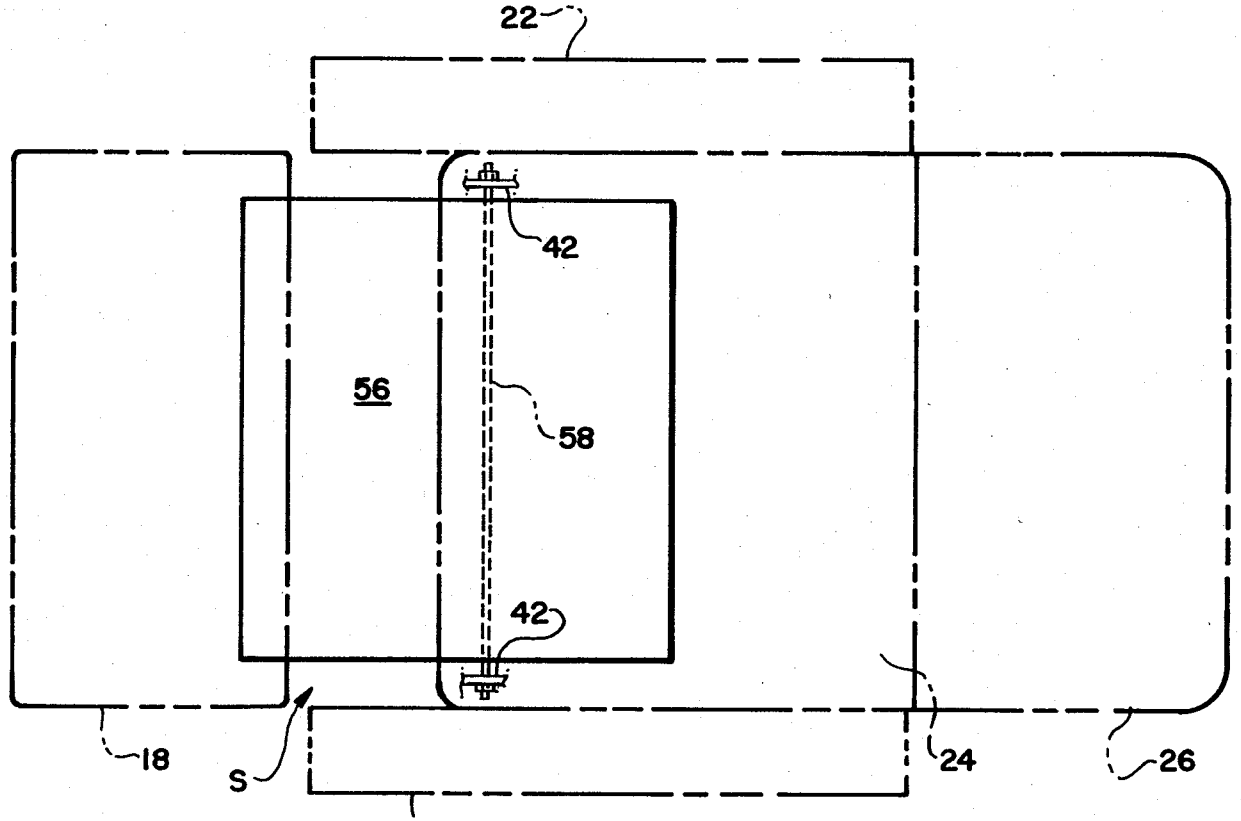
FIG. 8 is a top plan view of the recliner of FIG. 6.

The safety platform arrangement 10 solves this problem. The platform arrangement 10 basically includes a rectangular substantially planer upholstered platform member 56 pivotably attached to the footrest 18 along the side 18' thereof which is disposed uppermost in the non-reclining position of the chair 12 in FIG. 1 and is disposed rearwardmost in the footrest and reclining positions of the chair 12 in FIGS. 3 and 6. A transverse support rod 58 is affixed respectively to and extends transversely between the front footrest drive links 42 of the pair of linkage assemblies 28 at a slight spacing from the pivot connection between the front footrest drive links 42 and the respective seat mounting plate 32. The platform member 56 extends rearwardly from the footrest 18 and is supported restingly on the support rod 58. (See FIG. 2). Notably, during folding and unfolding movements of the linkage assemblies 28 between the folded condition of FIG. 1 and the fully unfolded condition of FIG. 6, the mounting location of the support rod 58 on the front footrest drive links 42 of the linkage assemblies 28 moves through only a relatively short arcuate span which is relatively normal to the seat mounting plate 32. Accordingly, the support rod 58 operates throughout the full range of folding and unfolding movement of the linkage assemblies 28 to support and maintain the platform member 56 in close proximity to the underside of the seat member 24 in generally parallel relation therewith. (See FIGS. 2, 4 and 7). Accordingly, as shown in the plan views of FIGS. 5 and 8, in each of the unfolded conditions of the linkage assemblies 28 in the corresponding FIGS. 3 and 6, the platform member 56 closes the space S which would otherwise normally exist between the extended footrest 18 and the seat member 24 and thereby prevents any object from extending into such space S and becoming entrapped in the chair 12 in the event of accidental, unexpected or unintended folding movement of the linkage assemblies 28 from either of the unfolded conditions of FIGS. 3 and 6 into the folded condition of FIG. 1. As an added advantage, the platform member 56 provides a pleasing continuity of appearance between the seat member 24 and the footrest 18 and substantially covers the unsightly interior linkage components of the recliner 12 which normally would be visible through the space S in the footrest and reclining positions of FIGS. 3 and 6.

Figure 9:
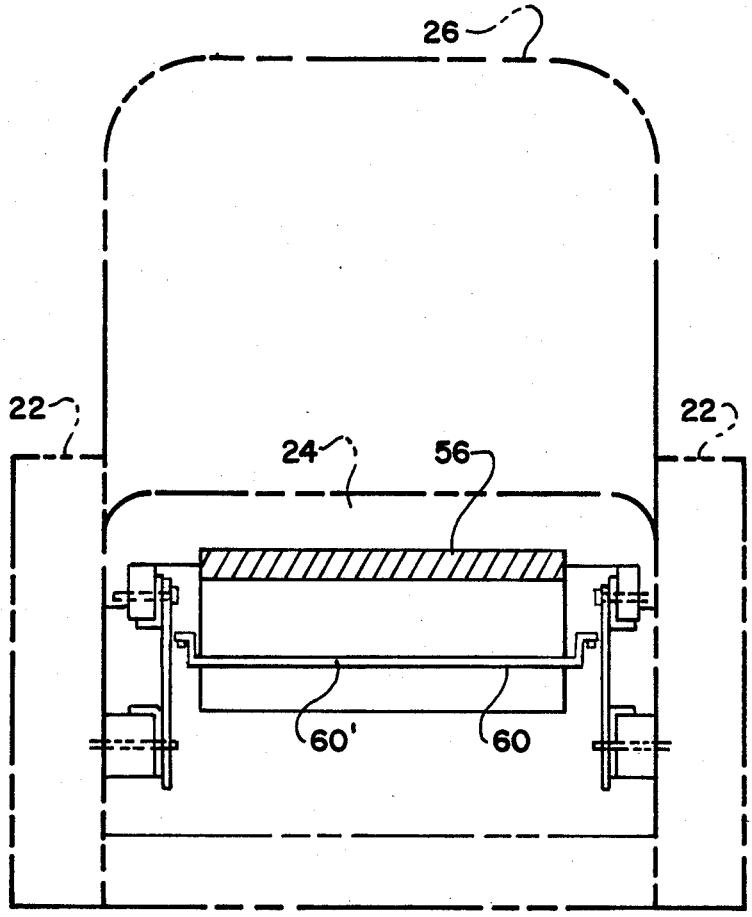
FIG. 9 is a vertical cross-section of the recliner similar to FIG. 6 showing a second embodiment of a support arrangement for the platform member of the safety platform arrangement of the present invention.

As will be understood, the mounting location of the support rod 58 on the linkage assemblies 28 is important to insure that the platform member 56 is maintained in close proximity to the seat member 24 throughout the full range of extending and retracting movement of the footrest 18 and particularly in both the footrest and reclining positions of the chair 12 prevailing when the linkage assemblies 28 are in their intermediate and fully unfolded conditions respectively. However, it will also be appreciated by those persons skilled in the art that the support rod 58 may be mounted at a number of other locations than on the front footrest drive link 42. For instance, the rear footrest drive link 40 follows a rather similar path of movement to the front footrest drive link 42 during folding and unfolding movements of the linkage assemblies 28 and, therefore, the support rod 58 could be similarly mounted on the rear footrest drive link 40 at a close spacing to its pivot connection with the seat mounting plate 32. Alternatively, the support rod could be affixed directly to the seat mounting plate 32 or to the underside of the seat members 24 to depend therefrom. For example, in FIG. 9, there is illustrated a U-shape support bracket 60 mounted directly to the underside of the seat member 24 transversely thereacross with the transverse bridging portion 60' of the bracket 60 providing support for the platform member 56 in the same manner as the support rod 58 of FIGS. 1–8. As those persons skilled in the art will readily understand, other appropriate mounting locations for the support rod 58, the support bracket 60 or another similar support member are found in substantially all conventional and known linkage assemblies utilized in footrest and recliner-type chairs of all varieties, whereby the present safety platform arrangement 10 may be readily adapted for use in virtually any such chair.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In a chair of the type having a seat structure, a footrest and means for selectively moving said footrest between a retracted position in a generally upright disposition with one side of said footrest facing upwardly adjacent said seat structure and an extended position at an outward spacing from said seat structure in a generally horizontal disposition with said one side facing rearwardly toward said seat structure, the improvement comprising safety platform means including a platform member pivotably affixed at said one side of said footrest for movement therewith and support means for constraining said platofrm member to move with said footrest in a generally horizontal path in close proximity to said seat structure between an inoprative position withdrawn within said seat structure in generally an angular relation with said footrest when said footrest is in its said retracted position and an operative position in general alignment with said footrest for spanning and substantially closing said spacing between said seat structure and said footrest when said footrest is in its said extended position, said safety platform means preventing objects from estending through said spacing to prevent accidental entrapment of objects in said spacing during movement of said footrest from its said extended position to its said retracted position.

2. In a chair of the type having a seat structure, a footrest and means for selectively moving said footrest between a retracted position adjacent said seat structure and an extended position at an outward spacing from said seat structure, said footrest moving means comprising an extendable and retractable linkage means on which said footrest is mounted, the improvement comprising safety platform means arranged for movement between an inoperative position withdrawn within said seat structure when said footrest is in its said retracted position and an operative position spanning and substantially closing said spacing between said seat structure and said footrest when said footrest is in its said extended positon, said safety platform means including a platform member attached to said footrest for movement therewith and support means attached to said linkage means to move therewith for continuously supporting said platform member resting on said support means and for constraining said platform member to move between said inoperative and operative positions, said safety platform means preventing objects from extending through said spacing platform means preventing objects from extending through said spacing to prevent accidental entrapment of objects in said spacing during movement of said footrest from its said extended position to its said retracted position.

3. The improvement in a chair according to claim 2 and characterized further in that said support means is operative to maintain said platform member in close proximity to said seat structure during movement of said platform member between said inoperative and operative positions.

4. The improvement in a chair according to claim 2, and characterized further in that said footrest moves between a generally upright disposition with one side thereof facing upwardly adjacent said seat structure in said retracted position of said footrest and a generally horizontal disposition with said one side facing rearwardly toward said seat structure in said extended position of said footrest, said platform member being pivotably affixed at said one side of said footrest and said safety platform means including support means for constraining said platform member to move with said footrest in a generally horizontal path in close proximity to said seat structure between generally an angular relation with said footrest in its said retracted position and general alignment with said footrest in its said extended position.

5. The improvement in a chair according to claim 1 and characterized further in that said support means is attached to said footrest moving means and said platform member rests on said support means.

6. The improvement in a chair according to claim 2 and characterized further in that said linkage means includes a pair of lazy tong linkage assemblies connected in spaced relation to one another for unitary extending and retracting movement, said support means comprising a cross member extending transversely between said lazy tong linkage assemblies.

7. The improvement in a chair according to claim 1 and characterized further in that said support means is attached to said seat structure and said platform member rests on said support means.

8. The improvement in a chair according to claim 7 and characterized further in that said seat structure includes a generally horizontal seat member, said support means comprising bracket means affixed to the underside of said seat member for receiving and guiding said platform member for movement between said inoperative and operative positions.

9. The improvement in a chair according to claim 8 and characterized further in that said bracket means comprises a U-shaped bracket member.

10. The improvement in a chair according to claim 1 and characterized further in that said footrest moving means comprises an extendable and retractable linkage means on which said footrest is mounted, said support means being affixed to said linkage means for movementtherewith, said platform member resting continuously on said support means during movement of said linkage means and said footrest.

11. The improvement in a chair according to claim 1 and characterized further in that said seat structure includes a generally horizontal seat member, said support means comprising bracket means affixed to the underside of said seat member for receiving and guiding said platform member for movement between said inoperative and operative positions.

12. In a reclining chair of the type having a chair frame, a seat structure, a footrest, and linkage means mounted on said chair frame and supporting said seat structure and said footrest for movement relative to said chair frame between a non-reclining position wherein said seat structure is generally upright relative to said chair frame and said footrest adjacent said chair frame and a reclining position wherein said seat structure is reclined relative to said chair frame and said footrest is extended at an outward spacing from said seat structure, the improvement comprising a safety platform member attached to said footrest for movement therewith between said non-reclining and reclining positions and support means affixed to said linkage means for movement therewith for supporting said platform member resting continuously on said support means during movement of said linkage means and said footrest and for constraining said safety platform member to move with said footrest between an inoperative positon withdrawn within said chair frame when said footrest is in said non-reclining position and an operative position spanning and substantially closing said spacing between said seat structure and said footrest when said footrest is in said reclining position, said safety platform member preventing objects from extending through said spacing to prevent accidental entrapment of objects in said spacing during movement of said footrest and seat structure from said reclining position to said non-reclining position.

13. The improvement in a recliner chair according to claim 12 and characterized further in that said linkage means includes a pair of lazy tong linkage assemblies connected in spaced relation to one another for unitary extending and retracting movement, said support means comprising a cross member extending transversely between said lazy tong linkage assemblies.

14. The improvement in a recliner chair according to claim 12 and characterized further in that said footrest moves between a generally upright disposition with one side thereof facing upwardly adjacent said seat structure in said non-reclining position of said footrest and a generally horizontal disposition with said one side facing rearwardly toward said seat structure in said reclining position of said footrest, said platform member being pivotably affixed to said one side of said footrest and said safety platform means including support means for constraining said platform member to move with said footrest in a generally horizontal path in close proximity to said seat structure between generally an angular relation with said footrest in its said non-reclining position and general alignment with said footrest in its said reclining position.

15. In a reclining chair of the type having a chair frame, a seat structure, a footrest, and linkage means mounted on said chair frame and supporting said seat structure and said footrest for movement relative to said chair frame between a non-reclining position wherein said seat structure is generally upright relative to said chair frame and said footrest is retracted in a generally upright disposition adjacent said chair frame with one side of said footrest facing upwardly adjacent said seat structure and a reclining position wherein said seat structure is reclined relative to said chair frame and said footrest is extended in a generally horizontal disposition at an outward spacing from said seat structure with said one side of said footrest facing rearwardly toward said seat structure, the improvement comprising a safety platform member pivotably affixed to said one side of said footrest for movement therewith between said retracted and reclining positions and support means affixed to one of said seat structure and said linkage means for constraining said safety platform member to move with said footrest in a generally horizontal path in close proximity to said seat structure between an inoperative position withdrawn within said chair frame in angular relation with said footrest when said footrest is in said non-reclining position and an operative position extending between said footrest and said seat structure in general alignment with said footrest spanning and substantially closing said spacing between said seat structure and said footrest when said footrest is in said reclining position, said safety platform member preventing objects from extending through said spacing to prevent accidental entrapment of objects in said spacing during movement of said footrest and seat structure from said reclining position to said non-reclining position.

16. The improvement in a recliner chair according to claim 15 and characterized further in that said support means is affixed to said linkage means for movement therewith, said platform member resting continuously on said support means during movement of said linkage means and said footrest.

17. The improvement in a recliner chair according to claim 16 and characterized further in that said linkage means includes a pair of lazy tong linkage assemblies connected in spaced relation to one another for unitary extending and retracting movement, said support means comprising a cross member extending transver TM sely between said lazy tong linkage assemblies.

18. The improvement in a recliner chair according to claim 15 and characterized further in that said seat structure includes a generally horizontal seat member, said support means comprising bracket means affixed to the underside of said seat member for receiving and guiding said platform member for movement between said inoperative and operative positions.

19. The improvement in a recliner chair according to claim 18 and characterized further in that said bracket means comprises a U-shaped bracket member.

20. The improvement in a chair according to claim 10 and characterized further in that said linkage means includes a pair of lazy tong linkage assemblies connected in spaced relation to one another for unitary extending and retracting movement, said support means comprising a cross member extending transversely between said lazy tong linkage assemblies.

* * * * *

UNITED STATES PATENT OFFICE

CERTIFICATE OF CORRECTION

Patent No. 4,660,883 Dated April 28, 1987

Inventor(s) Jerome R. Kowalski

It is certified that error appears in the above-identified patent and that said Letters Patent are hereby corrected as shown below:

Col. 3, Line 17, delete — dr — .
Col. 8, Line 5, delete "platofrm" and insert therefor — platform — .
Col. 8, Line 7, delete "inoprative" and insert therefor — inoperative — .
Col. 8, Line 15, delete "estending" and insert therefor — extending — .
Col. 8, Lines 40-41, delete "platform means preventing objects from extending through said spacing".
Col. 9, Line 29, delete "menttherewith" and insert therefor — ment therewith —.
Col. 9, Line 45, between "footrest" and "adjacent" insert — is retracted — .
Col. 11, Line 2, delete "transver TM sely" and insert therefor — transversely —.

Signed and Sealed this

Fifth Day of January, 1988

*Attest:*

DONALD J. QUIGG

*Attesting Officer* *Commissioner of Patents and Trademarks*